US009341445B2

(12) United States Patent
de Haas et al.

(10) Patent No.: US 9,341,445 B2
(45) Date of Patent: May 17, 2016

(54) ANTIBALLISTIC PANEL WITH FIRST AND SECOND LAMINATES HAVING FIBERS OF DIFFERENT TENSILE MODULUS

(75) Inventors: Marc-Jan de Haas, Apeldoorn (NL); Chinkalben Patel, Ancaster (CA)

(73) Assignees: Teijin Aramid BV (NL); Barrday, Inc. (CA)

( * ) Notice: Subject to any disclaimer, the term of this patent is extended or adjusted under 35 U.S.C. 154(b) by 22 days.

(21) Appl. No.: 14/115,117

(22) PCT Filed: Apr. 26, 2012

(86) PCT No.: PCT/EP2012/057588

§ 371 (c)(1),
(2), (4) Date: Nov. 1, 2013

(87) PCT Pub. No.: WO2012/150164

PCT Pub. Date: Nov. 8, 2012

(65) Prior Publication Data

US 2014/0060308 A1 Mar. 6, 2014

(30) Foreign Application Priority Data

May 3, 2011 (EP) ..... 11164552

(51) Int. Cl.
*F41H 5/04* (2006.01)

(52) U.S. Cl.
CPC ..... *F41H 5/0485* (2013.01)

(58) Field of Classification Search
USPC ..... 89/36.01–36.07; 428/911; 109/49.5
See application file for complete search history.

(56) References Cited

U.S. PATENT DOCUMENTS 5,471,906 A * 12/1995 Bachner, Jr. ..... F41H 1/02 109/49.5
5,851,932 A 12/1998 Dickson et al.
5,918,309 A * 7/1999 Bachner, Jr. ..... A41D 31/0061 2/2.5
5,960,470 A * 10/1999 Bachner, Jr. ..... A41D 31/0061 2/2.5
5,974,585 A * 11/1999 Bachner, Jr. ..... A41D 31/0061 2/2.5
6,151,710 A * 11/2000 Bachner, Jr. ..... F41H 5/0485 2/2.5
2002/0073473 A1* 6/2002 Bachner, Jr. ..... F41H 1/02 2/2.5
2003/0129900 A1* 7/2003 Chiou ..... B32B 5/26 442/134
2007/0234459 A1* 10/2007 Stewart ..... F41H 1/02 2/2.5
2009/0169917 A1* 7/2009 De Smet ..... B32B 15/016 428/654
2012/0024137 A1* 2/2012 Chiou ..... B32B 5/12 89/36.02

(Continued)

FOREIGN PATENT DOCUMENTS

WO 0025614 5/2000
WO 0159397 8/2001

(Continued)

OTHER PUBLICATIONS

International Search Report for PCT Application No. PCT/EP2012/057588 completed May 16, 2012.

*Primary Examiner* — Michael David
(74) *Attorney, Agent, or Firm* — Carlson, Gaskey & Olds, P.C.

(57) ABSTRACT

An antiballistic panel includes at least a first stack and a second stack. The first stack has a plurality of first laminates made of a first kind of fibers, and the second stack has a plurality of second laminates made of a second kind of fibers. Either the first kind of fibers or the second kind of fibers has a tensile modulus in the range of 40-85 GPa measured according to ASTM D7269. The other of the first kind of fibers or the second kind of fibers has a tensile modulus in the range of 86-140 GPa measured according to ASTM D7269.

11 Claims, 2 Drawing Sheets

(56) References Cited

U.S. PATENT DOCUMENTS

2012/0312151 A1* 12/2012 Patel ..... B32B 5/08
89/36.02
2013/0055882 A1* 3/2013 Egres, Jr. ..... D04C 1/02
89/36.02
2013/0284007 A1* 10/2013 de Haas ..... F41H 5/0435
89/36.02
2013/0295805 A1* 11/2013 de Haas ..... F41H 5/0435
442/1
2014/0069270 A1* 3/2014 De Haas ..... F41H 5/0485
89/36.02

FOREIGN PATENT DOCUMENTS

WO 0196805 12/2001
WO 2011022090 2/2011

* cited by examiner

ANTIBALLISTIC PANEL WITH FIRST AND SECOND LAMINATES HAVING FIBERS OF DIFFERENT TENSILE MODULUS

BACKGROUND OF THE INVENTION

The invention pertains to an antiballistic panel comprising at least a first kind of stack and a second kind of stack.

Antiballistic panels are well known in the prior art.

For example, a ballistic resistance panel is disclosed in WO 2008/14020. The panel according to this document comprises a first fiber layer and a second fiber layer, wherein the first and the second fiber layers have different types of high tenacity fibers. The first and the second fiber layers are formed of a plurality of plies, which have been laminated together.

In document WO 2008/115913 a multilayer composite fabric is disclosed. Also this composite fabric comprises a first and a second layer with high tenacity fibers, wherein the layers are directly or indirectly bonded together.

Document US 2005/0153098 discloses a hybrid-laminated sheet. The sheet comprises laminates, wherein each laminate comprises different layers. A first and a fourth layer is made of a first kind of fiber and a second and third layer is made of a second, different kind of fiber.

In all prior art documents the different fiber types are used in combination with each other. This means, different fiber types are combined in one layer with each other or layers of different fiber types make a laminate. In such a combination the positive effect of a special kind of fiber is overlapped by the other kind of fiber.

SUMMARY

It is therefore the aim of the present invention to create an antiballistic panel in which the properties of different fiber types are positively influenced by the other fiber type.

The aim is achieved by an antiballistic panel with the features of claim 1.

The antiballistic panel according to claim 1 comprises at least a first kind of stack (first stack) and a second kind of stack (second stack), wherein the first kind of stack has a plurality of first laminates made of a first kind of fibers and the second kind of stack has a plurality of second laminates made of a second kind of fibers, wherein the first kind of fibers has a tensile modulus in the range of 40-85 GPa measured according to ASTM D7269 and the second kind of fibers has a tensile modulus in the range of 86-140 GPa measured according to ASTM D7269.

Preferably the first kind of fibers has a tensile modulus in the range of 45-80 GPa, more preferred in the range of 50-75 GPa and most preferred in the range of 60-70 GPa measured according to ASTM D7269.

Preferably the second kind of fibers has a tensile modulus in the range of 90-135 GPa, more preferred in the range of 95-130 GPa and most preferred in the range 100-120 GPa measured according to ASTM D7269.

Due to the fact that the first stack exhibits as fiber only the first kind of fibers and the second stack exhibits as fiber only the second kind of fibers the properties of these different kinds of fibers still remain. It has shown that a panel comprising two different kind of stacks made of fibers with different tensile modulus has a better antiballistic performance than a panel comprising two stacks, wherein each stack consists of both types of different fibers. For a person skilled in the art this result was absolutely surprisingly.

The term tensile modulus should be understood as a measure of the resistance of yarn, tape or cord to extension as a force is applied. It is useful for estimating the response of a textile-reinforced structure to the application of varying forces and rates of stretching.

For the purposes of the present invention, a fiber is an elongate body the length dimension of which is much greater than the transverse dimensions of width and thickness. Accordingly, the term fiber includes tapes, monofilament, multifilament, ribbon, strip, staple and other forms of chopped, cut or discontinuous fiber and the like having regular or irregular cross-section. A yarn is a continuous strand comprised of many fibers or filaments.

A laminate should be understood as a combination of at least two fiber layers with a matrix material. Preferably, every fiber layer is impregnated with a matrix material, most preferred with the same matrix material. If different matrix materials are used the matrix materials distinguished from each other. As a first matrix material an elastomer for example can be used. As second matrix material an epoxy resin can be used. In another preferred embodiment the matrix materials in different fiber layers is the same or different and different fiber layers have different matrix contents. In an especially preferred embodiment a laminate has on two outer surfaces a film. Preferably, a laminate comprises four fiber layers, whereby each fiber layer is impregnated with a matrix material.

A fiber layer is preferably a unidirectional fiber layer or a woven fiber layer. Both mentioned layers could be impregnated with a matrix material. A stack can exhibits only unidirectional fiber layers or woven fiber layers or a combination of both kinds of layers.

The first stack as well as the second stack comprises a plurality of laminates. Each of the laminates preferably comprises at least two fiber layers. The first stack exhibits laminates made of a first kind of fibers. Preferably, no other fibers are used for the laminates and therefore for the first stack. The second stack exhibits also a plurality of laminates, but the laminates of the second stack are made of a second kind of fibers. Preferably, no other fibers are used for the laminates in the second stack. Due to this the first stack and the second stack are made of different fibers, wherein the fibers distinguish in respect to their tensile modulus.

In a preferred embodiment at least one layer, more preferred every layer of the first stack and/or second stack is made of tapes. This means at least one laminate, more preferred every laminate of the first stack and/or second stack comprises layers made of tapes. It is further preferred that at least one layer, more preferred every layer of the first stack and/or of the second stack is made of yarn.

Preferably, each of the plurality of laminates of the first and/or the second stack comprises unidirectional fiber layers, more preferred each laminate comprises at least two unidirectional fiber layers and most preferred four unidirectional fiber layers. Preferably, the fibers of the unidirectional layers are in a matrix. The fiber direction of a layer in a laminate has an angle relative to the fiber direction of an adjacent layer of the same laminate, wherein the angle is preferably between 40° and 100°, more preferred between 45° and 95° and most preferred approximately 90°.

Unidirectional fiber layers are built up by fibers, which are aligned parallel to each other along a common fiber direction. In a preferred embodiment unidirectional aligned tapes or yarns build up the layers of the first stack and/or of the second stack. If yarn builds up the layer, the unidirectionally arranged yarn bundles are coated or embedded with resin matrix material. The resin matrix material for the layers may be formed from a wide variety of elastomeric materials having desired characteristics. In one embodiment, the elastomeric materials used in such matrix possess an initial tensile modulus (modulus of elasticity) equal to or less than about 6,000 psi (41.4 MPa) as measured according to ASTM D638. More preferably, the elastomer has an initial tensile modulus equal to or less than about 2,400 psi (16.5 MPa). Most preferably, the elastomeric material has an initial tensile modulus equal to or less than about 1,200 psi (8.23 MPa). These resin materials are typically thermoplastic in nature but thermosetting materials are also useful. The proportion of the resin material to fiber in the layer may vary widely depending upon the end use and is usually in the range of 5-26% based on matrix weight in respect to matrix and fiber weight. Suitable matrix materials are SIS (styrene-isoprene-styrene) block copolymers, SBR (styrene butadiene rubber), polyurethanes, ethylene acrylic acid, polyvinyl butyral.

Preferably, at least one laminate of first and/or the second stack comprises at least a woven fiber layer.

Preferably, the number of laminates, which builds up a first and/or second stack is between 1 to 30. This means the first and/or second stack have between 2 and 120 layers.

Preferably, the panel has a body face and a strike face, whereby the first stack is arranged to the strike face and the second stack is arranged to the body face of the panel or reverse. The body face is arranged to the body of the wearer.

Suitable fibers for the layers of the first stack may be aramid fibers, like Twaron® Type 1000 or Twaron® Type 2100.

Suitable fibers for the layers of the second stack may also be aramid fibers, like Twaron® Type 2000 or Twaron® Type 2200.

Preferably, the first kind of fibers has an elongation at break in the range of 3.9-4.6% measured according to ASTM D7269.

It is also preferred if the second kind of fibers has an elongation at break in the range of 2.5-3.8% measured according to ASTM D7269.

Preferably, at least one laminate of the first and/or the second stack has at least one film on its outer surface. It is especially preferred; if a laminate has on each outer surface a film. This means each laminate of the first and/or second stack comprises preferably two films, whereby the films are arranged on the outer surfaces of the laminate. The films can be included on the layers, for example to permit different layers to slide over each other. The films may typically be adhered to one or both surfaces of each layer. Any suitable film may be employed, such as films made of polyolefin, e.g. linear low density polyethylene (LLDPE) films and ultrahigh molecular weight polyethylene (UHMWPE) films, as well as polyester films, nylon films, polycarbonate films and the like. These films may be of any desirable thickness. Typical film thickness ranges from about 2-20 μm.

Preferably, the panel is used for hard or soft anti-ballistic applications.

Preferably, the first stack comprises layers of low modulus aramid fibers, whereby the layers are unidirectional fiber layers. The layers are impregnated with a matrix of Rovene® 4019 (MCP, Mallard Creek Polymers). The second stack comprises layers of high modulus aramid fibers, whereby also the layers of the second stack are unidirectional fiber layers. The layers of the second stack are impregnated with a matrix mixture of approximately 60% Rovene® 4220 and approximately 40% Rovene® 4176. The first stack and the second stack can be arranged on the strike face or on the body face.

In another preferred embodiment the first stack comprises layers of high modulus aramid fibers, whereby the layers are unidirectional fiber layers. The layers are impregnated with Rovene® 4019. The second stack comprises layers of low modulus aramid fibers, whereby also the layers of the second stack are unidirectional fiber layers. The layers of the second stack are impregnated with a matrix mixture of approximately 60% Rovene® 4220 and approximately 40% Rovene® 4176. The first stack and the second stack can be arranged on the strike face or on the body face.

In another preferred embodiment the first stack comprises layers of low modulus aramid fibers, whereby the layers are unidirectional fiber layers. The layers are impregnated with Rhoplex® E-358 (Rohm and Haas). The second stack comprises layers of high modulus aramid fibers, whereby also the layers of the second stack are unidirectional fiber layers. The layers of the second stack are impregnated with a matrix mixture of approximately 60% Rovene® 4220 and approximately 40% Rovene® 4176. The first stack and the second stack can be arranged on the strike face or on the body face.

In another preferred embodiment the first stack comprises layers of high modulus aramid fibers, whereby the layers are unidirectional fiber layers. The layers are impregnated with Rhoplex® E-358. The second stack comprises layers of low modulus aramid fibers, whereby also the layers of the second stack are unidirectional fiber layers. The layers of the second stack are impregnated with a matrix mixture of approximately 60% Rovene® 4220 and approximately 40% Rovene® 4176. The first stack and the second stack can be arranged on the strike face or on the body face.

All % values in the four above-named embodiments are volume values.

The invention is further elucidated by figures.

DETAILED DESCRIPTION

Figure 1:
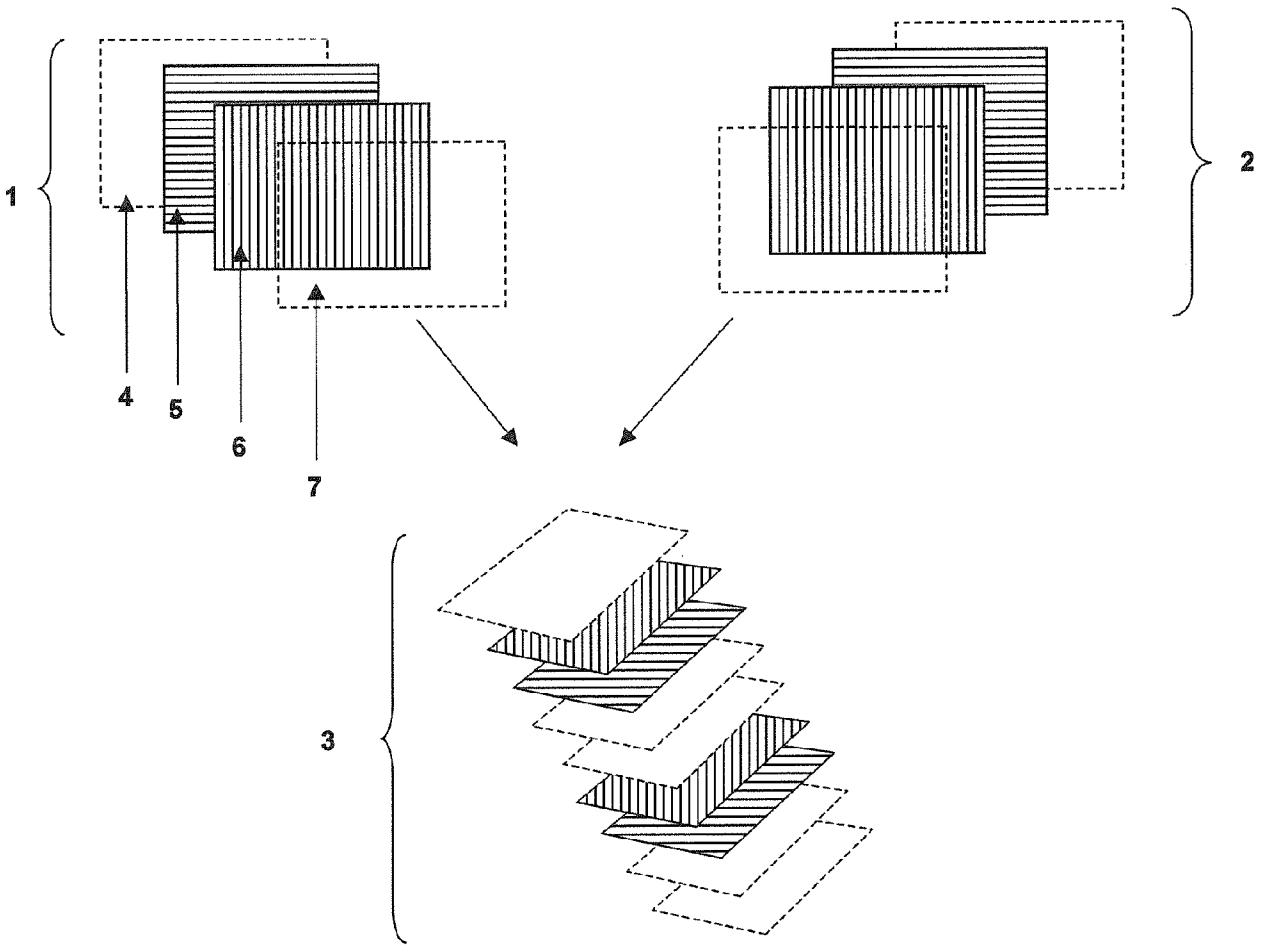
FIG. 1 schematically shows a panel comprising a first kind of stack and a second kind of stack.

In FIG. 1 schematically an antiballistic panel 3 is shown. The panel 3 comprises a first stack 1 and a second stack 2 each with one laminate. In the embodiment of FIG. 1 the first stack 1—this means the first laminate (and also the second stack 2, this means the second laminate) is built up by a film layer 4, a first unidirectional fiber layer 5, a second unidirectional fiber layer 6 and another film layer 7. The first unidirectional fiber layer 5 and the second unidirectional fiber layer 6 are impregnated with a matrix material. The unidirectional fiber layers 5 and 6 are cross plied to each other, this means the fiber direction of the fiber layer 5 has an angle of approximately 90° in respect to the fiber direction of the fiber layer 6. In this embodiment the first stack 1 and the second stack 2 have the same elements (two unidirectional fiber layers 5, 6, and two film layers 4, 7). It is also possible, that the first stack 1 comprises four fiber layers and the second stack 2 comprises two fiber layers or reverse. In all embodiments the first stack 1 distinguishes from the second stack 2 in respect to the used fiber tensile modulus. The fiber layers 5, 6 and the film layers 4, 7 are laminated together to form the first stack 1. In general, it is preferred to laminate the fiber layers with or without the film layers together to build up a laminate for the first stack 1 and/or for the second stack 2. The laminates are preferably arranged over each other to form the first and/or second stack. This means inside the stack the laminates are preferably not bonded together.

EXAMPLE 1

For the Example 1 three laminates each consisting of four fiber layers are built up. Each fiber layer is a unidirectional fiber layer (UD), whereby the fiber direction of the fibers of the fiber layers in each laminate was 0°, 90°, 0°, 90°. As matrix system for each fiber layer Prinlin B7137 AL from Henkel was chosen, which consists of a styrene-isoprene-styrene (SIS) block copolymer. During manufacturing of the UD fiber layer, this water-based matrix system is applied via a kiss roll to the fiber (yarn) of the fiber layer and subsequently dried on a hot-plate. Matrix concentration was determined from the dry unidirectional fiber layer (i.e. the concentration based on dry yarn weight) and is given in Table 1. Four unidirectional fiber layers were laminated into a 4-ply laminate with one 10 μm LDPE film on each outer side of the laminate (one laminate comprises two film layers), by using the lamination conditions indicated in Table 1. In total, a 4-ply laminate with LDPE-film has propagated through the laminator three times: the first time for 2-ply lamination (this means two UD fiber layers were laminated together), the second time for 4-ply lamination (this means two 2-ply sheets were laminated to one 4-ply laminate) and the third time for LDPE-film lamination on the 4-ply laminate. Temperature (T) and lamination speed (v) were kept at comparable levels for each passage, pressure was varied and is indicated by respectively P1 (first lamination), P2 (second lamination) and P3 (third lamination) in Table 1. Areal density of the 4-plied construction with LDPE-film on both sides was determined as well.

TABLE 1

Lamination conditions and construction of the different laminates

| Laminate | Yarn type | Lamination conditions T (° C.) | P1 N/cm² | P2 N/cm² | P3 N/cm² | v (m/min) | Matrix content (wt. %) | Areal density (g/m²) |
|---|---|---|---|---|---|---|---|---|
| Laminate 1 | T2000 1100 dtex f1000 | 120 | 35 | 10 | 10 | 1 | 17.2 | 243 |
| Laminate 2 | T2100 1100 dtex f1000 | 120 | 35 | 10 | 10 | 2 | 16.3 | 244 |
| Laminate 3 | T2200 1210 dtex f1000 | 120 | 35 | 10 | 10 | 1 | 17.1 | 258 |

All laminates (4-plied+LDPE-film on both outer sides) were tested at the same condition. A first sensor was arranged in a distance of 12 cm of the laminate. A second sensor is arranged behind the laminate (in respect to the muzzle) in a distance of 12 cm from the laminate. The distance between muzzle and laminate was 30 cm. The first sensor and the second sensor measure the bullet speed. The bullet is fired from an air-pressure rifle. The laminates are cut into test sample pieces, whereby the typical test sample dimensions are 118×118 mm. The bullet type used is the lead-based Super H-point (field line) produced by RUAG Ammotec GmbH with a caliber of .22 (5.5 mm) and a weight of 0.92 g. The bullet's incoming speed can be varied in the range from 240 m/s to about 360 m/s.

By subtracting the bullet kinetic energy ($\frac{1}{2}*mass_{bullet}*v^2_{bullet}$) after propagation through the laminate from the bullet kinetic energy before shield propagation through the laminate and subsequently dividing by the areal density of the laminate, a specific energy absorption (SEA) can be determined.

First Laminate

In the first laminate yarn Twaron Type 2000, f1000, 1100 dtex was used as fiber material. The yarn has a tensile modulus of 91 GPa measured according to ASTM D7269, the breaking tenacity was 2350 mN/tex measured according to D7269, the elongation at break in % was 3.5 measured according to D7269.

Second Laminate

In the second laminate yarn Twaron Type 2100, f1000, 1100 dtex was used as fiber material. The yarn has a tensile modulus of 58 GPa measured according to ASTM D7269, the breaking tenacity is 2200 mN/tex measured according to D7269, the elongation at break in % was 4.4 measured according to D7269.

Third Laminate

In the third laminate yarn Twaron Type 2200, f1000, 1210 dtex was used as fiber material. The yarn has a tensile modulus of 108 GPa measured according to ASTM D7269, the breaking tenacity is 2165 mN/tex measured according to D7269, the elongation at break in % is 2.8 measured according to D7269.

Figure 2:
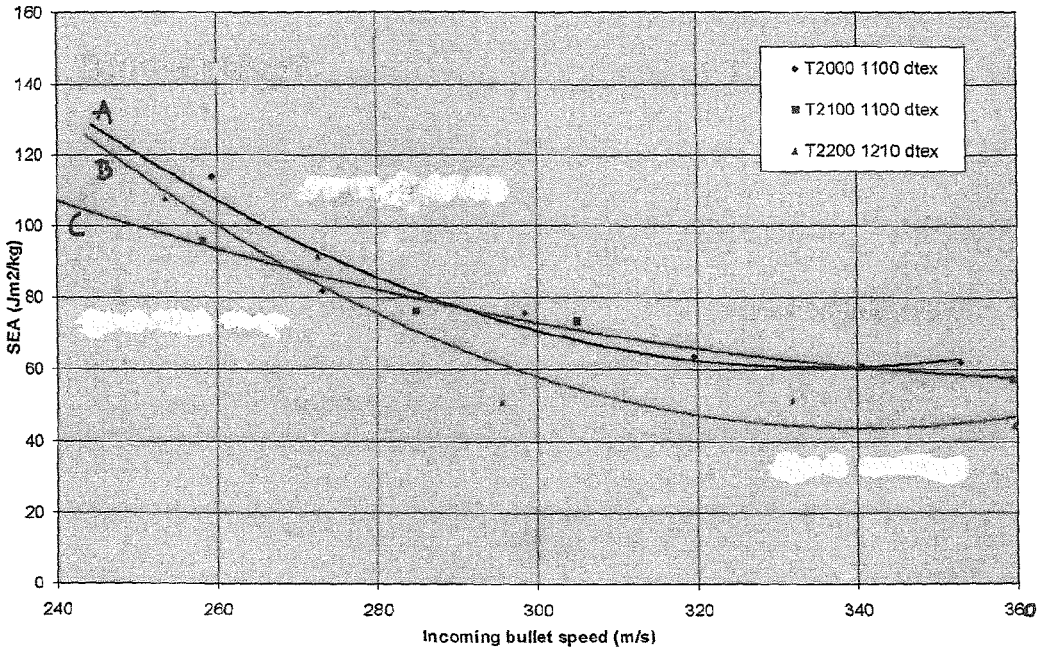
FIG. 2 shows the energy absorption of single laminates.

In FIG. 2 the specific energy absorption (SEA) of the laminates is shown as a function of incoming bullet speed.

Curve A represents the specific energy absorption (SEA) in respect to the bullet speed for the first laminate (yarn Twaron Type 2000, f1000, 1100 dtex). Curve B represents the specific energy absorption (SEA) in respect to the bullet speed for the third laminate (yarn Twaron Type 2200, f1000, 1210 dtex) and curve C for the second laminate (yarn Twaron Type 2100, f1000, 1100 dtex). It can be understood that the aim is to have an as high as possible SEA-value for each incoming bullet speed. The A curve represents the laminate made of high modulus fiber and this laminate shows a very good energy absorption in the low bullet speed area. On the other hand the C curve represents a laminate made of low modulus fibers and it can be seen that this laminate has a lower energy absorption in the low speed area (in comparison with the laminates represents by curve A and B). The B curve represents also a laminate made of high modulus fibers and also this laminate shows a high energy absorption in the low bullet speed area (comparable to the A curve). In the high speed area the energy absorption of curve C and curve A are comparable with each other, this means the laminate made of low modulus fibers shows a similar energy absorption like the laminate made of the high modulus fiber. It is therefore proven that an antiballistic panel comprising two stacks, whereby a first stack is made of at least one laminate of low tensile modulus fibers and the second stack is made of at least one laminate of high modulus fibers, has a similar energy absorption than a antiballistic panel made of two stacks, whereby both stacks are made of laminates of high tensile modulus fibers. Advantageously, an antiballistic panel in the disclosed technique (this means with two different kind of fibers for each stack) is cheaper without decreasing the antiballistic performance.

EXAMPLE 2

For this example three types of laminates each consisting of four fiber layers are built up.

Each fiber layer is a unidirectional fiber layer (UD), whereby the fiber direction of the fibers of the fiber layers in each laminate was 0°, 90°, 0°, 90°. As matrix system for each fiber layer Prinlin B7137 AL from Henkel was chosen, which consists of a styrene-isoprene-styrene (SIS) block copolymer. During manufacturing of the UD fiber layer, this water-based matrix system is applied via a kiss roll to the fiber (yarn) of the fiber layer and subsequently dried on a hotplate. Matrix concentration was determined from the dry unidirectional fiber layer (i.e. the concentration based on dry yarn weight) and is given in Table 2. Four unidirectional fiber layers were laminated into a 4-ply laminate with one 10 μm LDPE film on each outer side of the laminate (one laminate comprises two film layers), by using the lamination conditions indicated in Table 2. In total, a 4-ply laminate with LDPE-film has propagated through the laminator three times: the first time for 2-ply lamination (this means two UD fiber layers were laminated together), the second time for 4-ply lamination (this means two 2-ply sheets were laminated to one 4-ply laminate) and the third time for LDPE-film lamination on the 4-ply laminate. Temperature (T) and lamination speed (v) were kept at comparable levels for each passage, pressure was varied and is indicated by respectively P1 (first lamination), P2 (second lamination) and P3 (third lamination) in Table 2. Areal density of the 4-plied construction with LDPE-film on both sides was determined as well according to ASTM D3776-96. The matrix content (wt. %) is based on dry fiber weight:

$$\text{Matrix content}=(\text{Matrix weight/dry fiber weight})\times 100\%$$

TABLE 2

Lamination conditions and construction of the different laminates

| Laminate | Yarn type | Lamination conditions T (° C.) | P1 N/cm² | P2 N/cm² | P3 N/cm² | v (m/min) | Matrix content (wt. %) | Areal density (g/m²) |
|---|---|---|---|---|---|---|---|---|
| Laminate 4 | T2000 1100 dtex f1000 | 120 | 35 | 35 | 10 | 2 | 17.2 | 234 |
| Laminate 5 | D2600 1100 dtex f1000 | 120 | 35 | 35 | 10 | 2 | 16.0 | 226 |
| Laminate 6 | D2600 1110 dtex f1000 | 120 | 35 | 35 | 10 | 2 | 15.6 | 227 |

The 3 laminates as presented in Table 2 are characterized as follows:

Laminate No. 4

In Laminate No. 4 yarn Twaron Type 2000, f1000, 1100 dtex was used as fiber material. The yarn has a tensile modulus of 91 GPa measured according to ASTM D7269, the breaking tenacity was 2350 mN/tex measured according to D7269, the elongation at break in % was 3.5 measured according to D7269.

Laminate No. 5

In Laminate No. 5 yarn Twaron Type D2600 (development type), f2000, 1100 dtex was used as fiber material. The yarn has a tensile modulus of 63 GPa measured according to ASTM D7269, the breaking tenacity is 2502 mN/tex measured according to D7269, the elongation at break in % was 4.3 measured according to D7269.

Laminate No. 6

In Laminate No. 6 yarn Twaron Type D2600 (development type), f2000, 1100 dtex was used as fiber material. The yarn has a tensile modulus of 96 GPa measured according to ASTM D7269, the breaking tenacity is 2582 mN/tex measured according to D7269, the elongation at break in % is 3.6 measured according to D7269.

The resulting panels were evaluated for their anti-ballistic capability by measuring $v_{50}$, i.e. the velocity in m/s, at which 50% of the projectiles were stopped. The projectiles used were .357 Magnum and 9 mm DM41, 0° obliquity. The evaluation of $v_{50}$ is described e.g. in MIL STD 662F.

The $v_{50}$ values were measured for three different antiballistic panel constructions. The panels that were tested against .357 Magnum had an areal density of about 3.4 kg/m² (15 laminates) and the panels that were tested against 9 mm DM41 had an areal density of about 4.3 kg/m² (19 laminates):

In construction 1, all laminates in the panel are Laminate No. 4.

In construction 2, about 50% of the laminates in the panel are Laminate No. 5 and about 50% of the laminates in the panel are Laminate No. 6. For panels tested against 0.357 Magnum this resulted in 8 layers of Laminate No. 5 and 7 layers of Laminate No. 6. For panels tested against 9 mm DM41 ammunition this resulted in 10 layers of Laminate No. 5 and 9 layers of Laminate No. 6. The first stack of Laminates No. 5 is arranged to the strike face and the second stack of Laminates No. 6 is arranged to the body face.

In construction 3, about 50% of the laminates in the panel are Laminate No. 5 and about 50% of the laminates in the panel are Laminate No. 6. For panels tested against .357 Magnum this resulted in 8 layers of Laminate No. 5 and 7 layers of Laminate No. 6. For panels tested against 9 mm DM41 ammunition this resulted in 10 layers of Laminate No. 5 and 9 layers of Laminate No. 6. The first stack of Laminates No. 6 is arranged to the strike face and the second stack of Laminates No. 5 is arranged to the body face.

TABLE 3

| Construction | $V_{50}$ (.357 Magnum) | $V_{50}$ (9 mm DM 41) |
|---|---|---|
| Construction 1 (15 layers Laminate No. 4) | 451 m/s | |
| Construction 1 (19 layers Laminate No. 4) | | 481 m/s |
| Construction 2<br>8 layers Laminate No. 5 strike face<br>7 layers Laminate No. 6 body face | 454 m/s | |
| Construction 2<br>10 layers Laminate No. 5 strike face<br>9 layers Laminate No. 6 body face | | 507 m/s |
| Construction 3<br>7 layers Laminate No. 6 strike face<br>8 layers Laminate No. 5 body face | 465 m/s | |
| Construction 3<br>9 layers Laminate No. 6 strike face<br>10 layers Laminate No. 5 body face | | 496 m/s |

From Table 3 it can be seen that an antiballistic panel consisting of two stacks, wherein the first stack consists of laminates made of fibers with a modulus of 63 GPa and the second stack consists of laminates made of fibers with a modulus of 96 GPa, has higher $v_{50}$ values compared to an antiballistic panel consisting only of laminates made of fibers with a modulus of 91 GPa.

REFERENCE NUMBERS

1 first stack
2 second stack
3 panel
4 film (film layer)
5 fiber layer
6 fiber layer
7 film (film layer)
A curve
B curve
C curve

The invention claimed is:

1. Antiballistic panel comprising at least a first stack and a second stack, wherein the first stack has a plurality of first laminates made of a first kind of fibers and the second stack has a plurality of second laminates made of a second kind of fibers, wherein each of the laminates of the plurality of first laminates and the plurality of second laminates includes a combination of at least two fiber layers with a matrix material, wherein either the first kind of fibers or the second kind of fibers has a tensile modulus in the range of 40-85 GPa measured according to ASTM D7269-07 and the other of the first kind of fibers or the second kind of fibers has a tensile modulus in the range of 86-140 GPa measured according to ASTM D7269-07.

2. Antiballistic panel according to claim 1, wherein each laminate of at least one of the first stack and the second stack comprises at least one unidirectional fiber layer.

3. Antiballistic panel according to claim 2, wherein the fibers of at least two unidirectional fiber layers of the laminate are arranged under an angle of 90° in respect to each other.

4. Antiballistic panel according to claim 1, wherein each laminate of at least one of the first stack and the second stack comprises at least one woven fiber layer.

5. Antiballistic panel according claim 1, wherein the first kind of fibers have the tensile modulus in the range of 40-85 GPa and the second kind of fibers has the tensile modulus in the range of 86-140 GPa, and the panel has a body face and a strike face and wherein the first stack is arranged to the strike face and the second stack is arranged to the body face of the panel.

6. Antiballistic panel according to claim 1, wherein the first kind of fibers have the tensile modulus in the range of 40-85 GPa and the second kind of fibers has the tensile modulus in the range of 86-140 GPa, and the panel has a body face and a strike face and wherein the second stack is arranged to the strike face and the first stack is arranged to the body face of the panel.

7. Antiballistic panel according to claim 1, wherein at least one laminate of at least one of the first stack or the second stack has at least one film on its outer surface.

8. Antiballistic panel according to claim 1, wherein the first kind of fibers has an elongation at break in the range of 3.9-4.6% measured according to ASTM D7269-07.

9. Antiballistic panel according to claim 1, wherein the second kind of fibers has an elongation at break in the range of 2.5-3.8% measured according to ASTM D7269-07.

10. Antiballistic panel according to claim 1, wherein the laminates of the plurality of first laminates and the laminates of the plurality of second laminates include different matrix materials.

11. Antiballistic panel according to claim 1, wherein the first kind of fibers and the second kind of fibers are different kinds of aramid fibers.

* * * * *